US012774132B2

(12) United States Patent
Defert et al.

(10) Patent No.: US 12,774,132 B2
(45) Date of Patent: Oct. 27, 2026

(54) HEAD FOR THE MANUFACTURE OF A FLEXIBLE TUBE AND TUBE COMPRISING SUCH A HEAD

(71) Applicant: ALBEA SERVICES, Gennevilliers (FR)

(72) Inventors: Sylvain Defert, Gennevilliers (FR); Franck Fritsch, Gennevilliers (FR)

(73) Assignee: ALBEA SERVICES, Courbevoie (FR)

( * ) Notice: Subject to any disclaimer, the term of this patent is extended or adjusted under 35 U.S.C. 154(b) by 112 days.

(21) Appl. No.: 17/965,273

(22) Filed: Oct. 13, 2022

(65) Prior Publication Data

US 2023/0122129 A1 Apr. 20, 2023

(30) Foreign Application Priority Data

Oct. 14, 2021 (FR) ..... 2110943

(51) Int. Cl.

| | |
|---|---|
| ***B65D 55/02*** | (2006.01) |
| ***B65D 35/10*** | (2006.01) |
| ***B65D 35/44*** | (2006.01) |
| *B65D 47/08* | (2006.01) |

(52) U.S. Cl.

CPC ..... *B65D 35/44* (2013.01); *B65D 35/10* (2013.01); *B65D 55/024* (2013.01); *B65D 47/0804* (2013.01); *B65D 2401/15* (2020.05)

(58) Field of Classification Search

CPC ..... B65D 2251/1025; B65D 2251/105; B65D 41/34; B65D 2401/40; B65D 2401/15; B65D 55/024; B65D 2401/20; B65D 2401/35; B65D 2251/1058; B65D 2251/1016

USPC ..... 220/268; 215/237, 253

See application file for complete search history.

(56) References Cited

U.S. PATENT DOCUMENTS

| | | | | | |
|---|---|---|---|---|---|
| 4,420,089 | A * | 12/1983 | Walker | B65D 55/02 | 222/153.07 |
| 4,487,324 | A * | 12/1984 | Ostrowsky | B65D 47/0814 | 215/253 |
| 5,386,918 | A * | 2/1995 | Neveras | B65D 47/0838 | 215/254 |
| 5,392,938 | A * | 2/1995 | Dubach | B65D 47/0814 | 220/254.5 |
| 6,269,986 | B1 * | 8/2001 | Gross | B65D 47/0804 | 222/153.06 |
| 2008/0110933 | A1 * | 5/2008 | Goncalves | B65D 47/2031 | 222/153.05 |
| 2010/0170910 | A1 * | 7/2010 | Ludewigs | B65D 47/0838 | 215/254 |
| 2011/0000928 | A1 * | 1/2011 | Antier | B65D 55/024 | 220/801 |
| 2014/0097150 | A1 * | 4/2014 | Antier | B65D 43/0235 | 215/354 |

(Continued)

*Primary Examiner* — Allan D Stevens

(74) *Attorney, Agent, or Firm* — Morgan, Lewis & Bockius LLP

(57) ABSTRACT

A head for the manufacture of a flexible tube for containing a liquid or pasty product, having a reduced height in relation to its diameter and comprising a base configured to be attached to a skirt of said tube and a cover pivotally mounted on the base between an open position and a closed position, the head comprising at least one anti-tamper system having at least two legs projecting from the cover, the legs being connected to each other by at least one continuous breakable bridge.

14 Claims, 10 Drawing Sheets

(56) References Cited

U.S. PATENT DOCUMENTS

| | | | | |
|---|---|---|---|---|
| 2016/0137365 | A1* | 5/2016 | Gonzalez Sanchez | B65D 43/166 220/319 |
| 2020/0180824 | A1* | 6/2020 | Mühlemann | B65D 47/0838 |
| 2020/0331668 | A1* | 10/2020 | Gonzalez Sanchez | B65D 51/00 |
| 2023/0017507 | A1* | 1/2023 | Athay | B65D 47/0838 |

* cited by examiner

Fig. 12
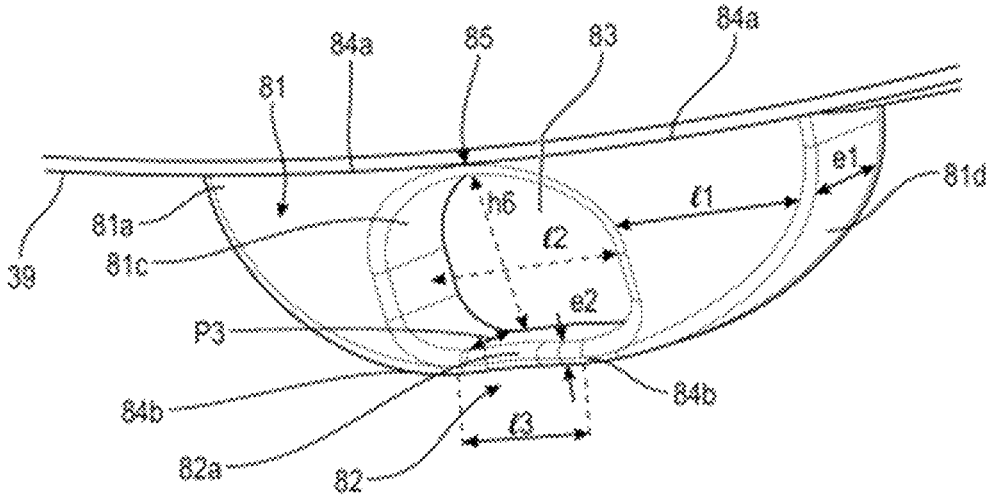
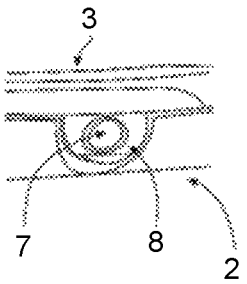
Fig. 13A
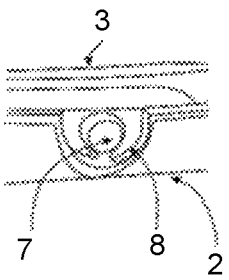
Fig. 13B
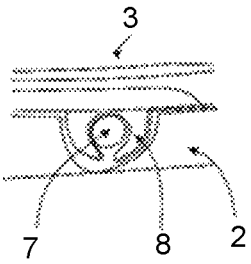
Fig. 13C

HEAD FOR THE MANUFACTURE OF A FLEXIBLE TUBE AND TUBE COMPRISING SUCH A HEAD

REFERENCE TO RELATED APPLICATION

This application is related to and claims priority benefits from FR Application No. 2110943, filed Oct. 14, 2021, and entitled "Tété pour la fabrication d'un tube souple et tube comprenant une telle tété," the entire content of which is incorporated herein by this reference.

TECHNICAL FIELD

The invention relates to a head for the manufacture of a flexible tube, also referred to as a tube head or sealing cap or "service cap" or "hinged cap" or "flip top". The invention also relates to a flexible tube comprising such a head. The flexible tube is suitable for storing and dispensing a fluid, creamy or pasty material. It is generally a material belonging to the cosmetic, food, household, pharmaceutical or para-pharmaceutical field.

BRIEF SUMMARY

A tube head comprises a base configured to be mounted on a tube skirt and a pivoting cover attached to the base by means of a hinge. Such a head offers the assurance that the cover remains secured to the base and thus to the tube, unlike a conventional dispensing head with a removable plug which, once detached, can be dropped and unintentionally abandoned anywhere. In addition, such a head offers the consumer the possibility to manipulate the tube with one hand. The user only has to give a simple pulse of the thumb to trigger the opening or the closing of the cover in relation to the base.

As the opening of the cover with respect to the base is designed to be executed in a simple manner without much effort, it is necessary to provide an anti-tamper system at the level of the tube head allowing to prevent the cover from being opened accidentally before the first use and to guarantee to the consumer that the product has not been opened before this first use.

To form the anti-tamper system, the prior art teaches a solution consisting of a circular ring or a tongue that connects the cover to the base by means of breakable bridges. The anti-tamper system may also take the form of a leg formed on the cover and intended to be inserted into an opening in the base, the leg being connected to the cover by at least one breakable bridge. In each of the above solutions, the breakable bridge or the breakable bridges are intended to be broken when the service cap is first opened, thereby allowing to release the cover with respect to the base.

In the case of an anti-tamper system formed from a tongue, it constitutes a waste for disposal once the breakable bridges have been broken. Thus, the tongue becomes a potential source of environmental pollution. In some cases, the tongue leaves an unsightly opening on the tube head. When the anti-tamper system is formed from a circular ring, it remains in position on the tube head. However, the ring is unusable afterwards and is still perceived as a bulky and unsightly element. The same is true when the anti-tamper system is formed from at least one leg of the cover in cooperation with an opening in the base: after breaking the breakable bridges, the leg remains blocked in the opening, thus giving an unsightly appearance while being unusable.

There is therefore a need for a tube head with an anti-tamper system that at least partly overcomes the above-mentioned disadvantages.

Thus the invention proposes a head for the manufacture of a flexible tube intended to contain a liquid or pasty product, said head having a reduced height in relation to its diameter and comprising a base configured to be attached to a skirt of a flexible tube and a cover pivotally mounted on the base between an open position and a closed position, the head comprising at least one anti-tamper system having at least two legs projecting from the cover, the legs being connected to each other by at least one continuous breakable bridge.

"Continuous" means that the bridge extends from one end of a first leg to one end of a second leg without the presence of an intermediate third element. "Breakable" means that the bridge can be broken by a minimal force, unlike the legs which cannot be broken or detached from the cover by this minimal force. In other words, the term "breakable" in relation to the bridge is introduced in contrast to the non-breakable nature of the legs and the permanent nature of the connection between the legs and the cover.

Thus, the invention allows to maintain the legs attached to the cover and thus preserve, after the breakable bridge or bridges have been broken, the general appearance formed by the cover and the legs. In addition, the invention opens up the possibility for the legs to perform new functions after the breakable bridge or bridges have been broken. In particular, the legs thus preserved in their integrity can be used as a means for holding the cover in the closed position.

The invention may also comprise any of the following characteristics, individually or in any technically feasible combination:

- the anti-tamper system comprises a pin formed at the level of the base;
- the at least one breakable bridge is designed so that when the cover is closed for the first time, the legs cooperate with the pin of the base without breaking the breakable bridge and that when the cover is opened for the first time, the breakable bridge is broken;
- the pin is bevelled so as to facilitate a placing and a maintain of the anti-tamper system around the pin;
- the pin extends in projection from a lateral wall of the base in a direction orthogonal or a direction substantially inclined with respect to said lateral wall;
- the pin is formed in an undercut embodied in the lateral wall of the base,
- the legs are intended to be housed in the undercut embodied in the lateral wall of the base when the cover is in the closed position;
- the pin has an inclined front face, a convex upper face and a horizontal lower face;
- the convex upper face and the horizontal lower face of the pin extend from a vertical face of the undercut formed in the lateral wall of the base;
- the inclined front face of the pin extends from the convex face of the pin;
- the inclined front face comprises an upper portion and a lower portion which form a distal edge of the pin;
- the legs extend from a lower edge of a lateral wall of the cover in a plane of said lateral wall;
- the legs and the at least one breakable bridge form an opening intended to be positioned around the pin;
- the legs and the at least one breakable bridge form a concave internal face around said opening;
- said concave internal face is intended to rest on the convex upper face of the pin;

the legs and the at least one breakable bridge form a substantially rectilinear internal face around said opening;

said rectilinear internal face is intended to be positioned opposite the horizontal planar face of the pin;

the opening formed by the legs has a height greater than a height and a depth of the pin so as to prevent when the legs are placed around the pin, contact between the at least one breakable bridge and the pin;

the pin opens out of the opening formed by the legs when the cover is in the closed position;

the at least one breakable bridge is thinner than the at least two legs;

the at least one breakable bridge is configured to be broken when the cover is first opened without loss of material;

the at least one breakable bridge is located at a distance from a concave bottom of the undercut embodied in the lateral wall of the base when the cover is in the closed position.

According to a second aspect, the invention also relates to a tube comprising a tube head as described above and a flexible skirt.

The invention according to this second aspect may also comprise any of the following characteristics, taken individually or in any technically possible combination:

the skirt is attached directly to the tube head;

the skirt is attached to the tube head by high temperature welding or by over-moulding.

BRIEF DESCRIPTION OF THE DRAWINGS

The invention will be better understood and other details, characteristics and advantages of the invention will become apparent from the following description, which is given by way of non-limiting example and with reference to the attached drawings in which:

FIG. 12 is an isometric view of another detail of FIG. 1.

FIGS. 13A-13C illustrate different states of an anti-tamper system of the head according to the invention.

DETAILED DESCRIPTION

By convention, the central axis Y is an axis passing through the middle of the tube head perpendicular to a plane containing a lower edge of the tube head. The central axis Y is located substantially equidistant from two diametrically opposed points of said edge. A direction orthogonal to the central axis Y is referred to as radial direction.

In the following detailed description of the figures, the terms "upper" and "lower" or "top" and "bottom" will be used without limitation in reference to the central axis Y.

Similarly, unless otherwise stated, the terms "outer or external" and "inner or internal" are used with reference to the radial direction, an outer element being radially further from the central axis Y than an inner element.

In the following description, elements with an identical structure or similar functions will be referred to by the same references.

Figure 6:
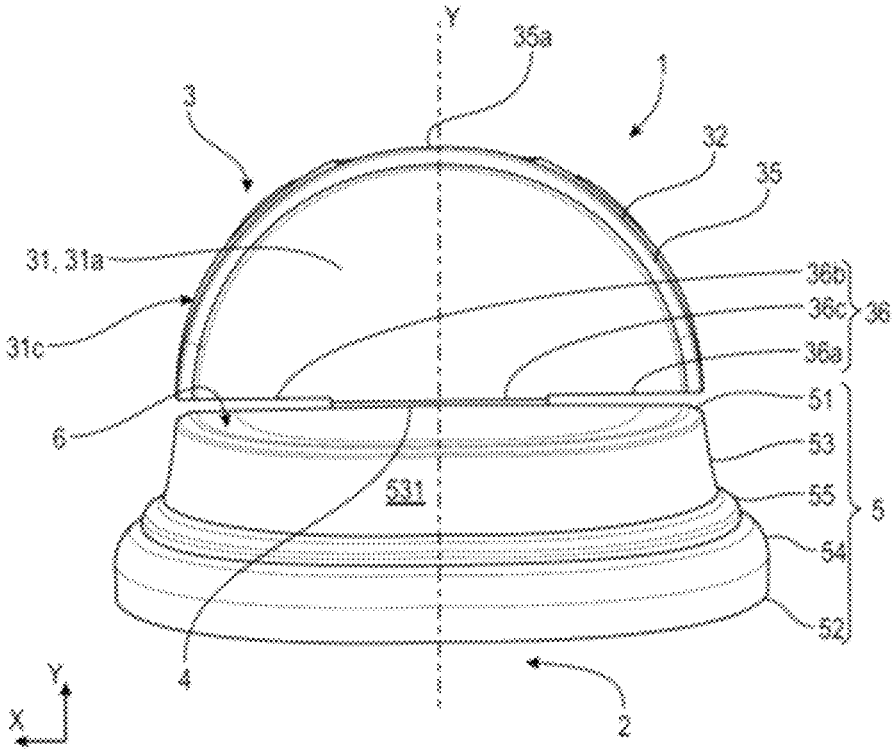
FIG. 6 is a rear isometric view of the head according to the invention.
Figure 7:
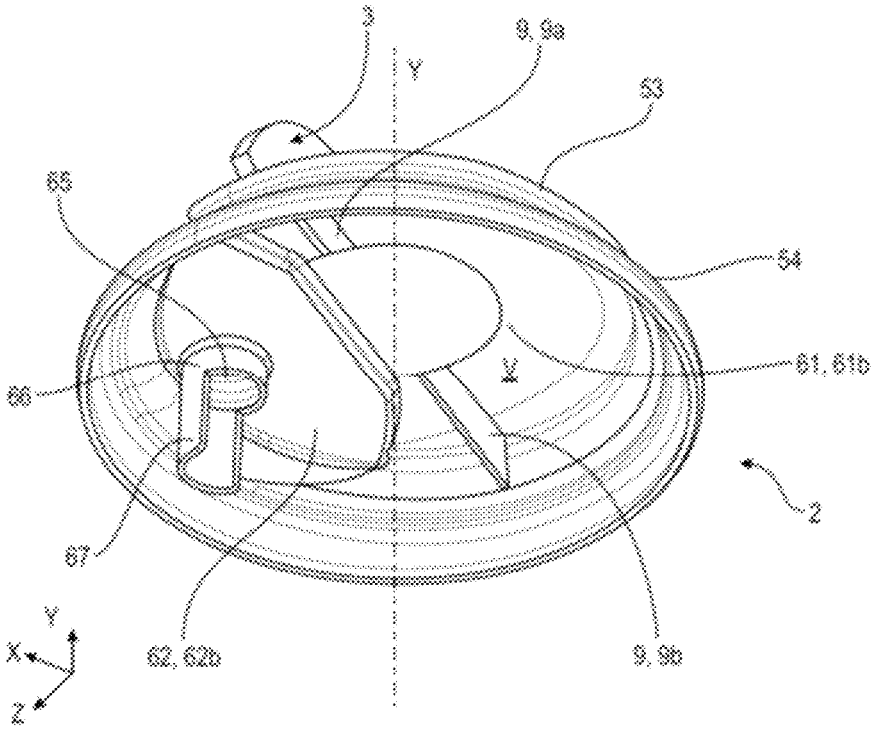
FIG. 7 is a bottom isometric view of the invention.
Figure 8:
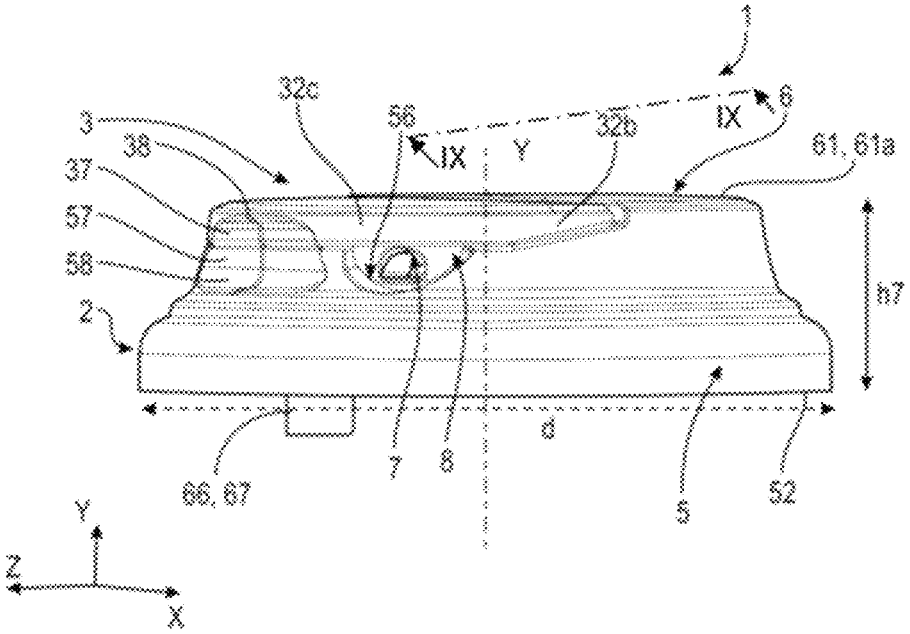
FIG. 8 is a right isometric view of the head according to the invention in a closed configuration.
Figure 9:
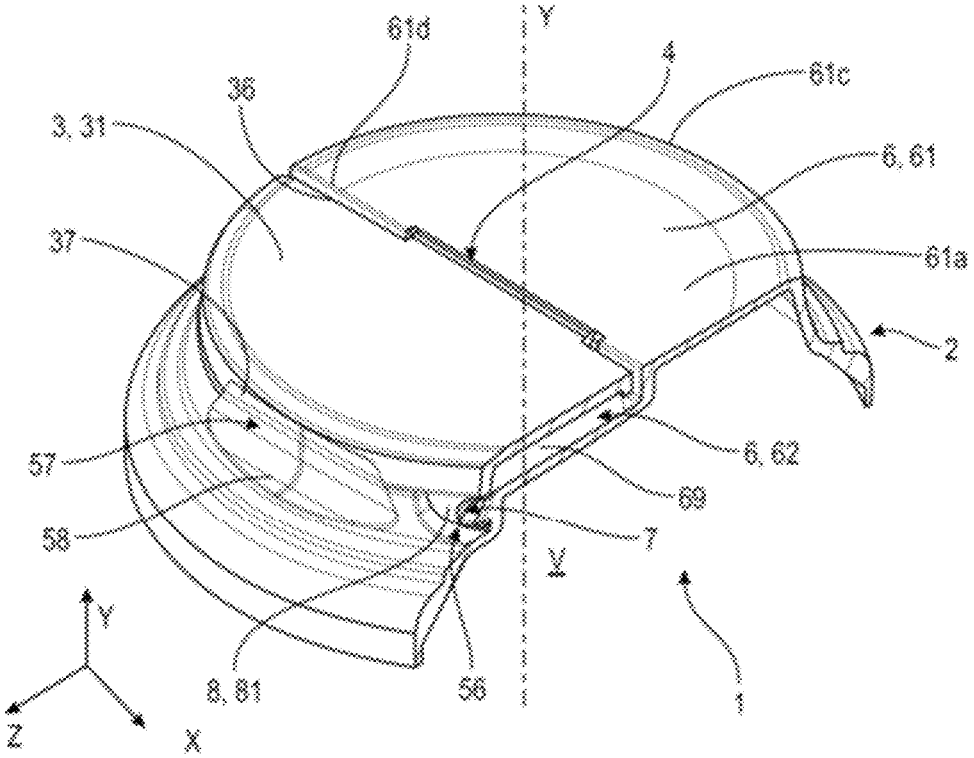
FIG. 9 is an isometric sectional view of the head when viewed along the section line IX-IX in FIG. 8 according to the invention in a closed configuration.

As illustrated in FIGS. 1-9, the present invention relates to a head 1 for the manufacture of a flexible tube 100 intended to contain a liquid or pasty product. The head 1 comprises a base 2 and a cover 3. The base 2 is configured to be mounted or to receive a skirt 50 of the tube 100. The cover 3 is pivotally mounted on the base 2 by means of a hinge 4 (visible in FIGS. 1, 2, 4, 6). Thus, the cover 3 can be moved between an open and a closed position (FIGS. 8 and 9). In the open position, the cover 3 is straightened with respect to the base 2. In the closed position, the cover 3 is folded back against the base 2 and hermetically closes the flexible tube.

The head 1 also comprises an anti-tamper system allowing to prevent the cover 3 from being opened unintentionally before the first use and to guarantee the consumer that the tube has not been opened before this first use. The anti-tamper system comprises at least one means formed at the level of the cover and at least one means formed at the level of the base. The means of the anti-tamper system and their operation will be described below.

Figure 4:
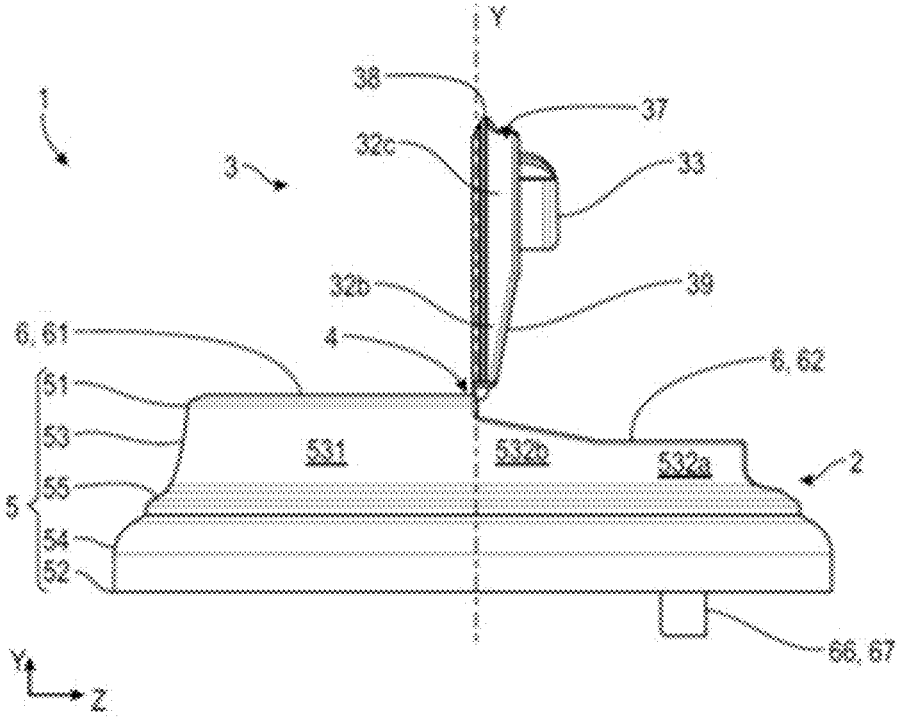
FIG. 4 is a left side view of the head according to the invention.
Figure 5:
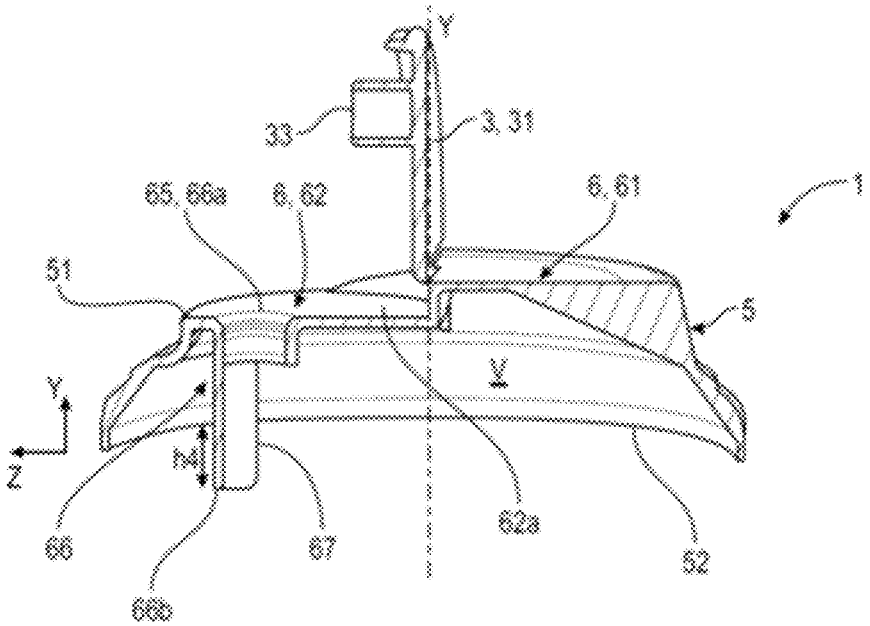
FIG. 5 is an isometric sectional view of the head when viewed along the section line V-V in FIG. 2 according to the invention.

Still referring to FIGS. 1 to 9, the base 2 comprises an annular lateral wall 5 and an upper wall 6 which form an internal volume V (visible in particular in FIGS. 5, 7, 9). In particular, with reference to FIGS. 4, 5 and 6, the annular lateral wall 5 comprises an upper edge 51 closed by the upper wall 6. In addition, the annular lateral wall 5 comprises a lower edge 52 forming a lower access opening to the volume V.

In the embodiment shown in FIGS. 4 and 6, the annular lateral wall 5 comprises an upper skirt 53 and a lower skirt 54. The upper skirt 53 has a smaller diameter than a diameter of the lower skirt 54. In addition, the upper skirt 53 is connected to the lower skirt 54 by a shoulder 55. Thus, the upper skirt 53, the lower skirt 54 and the shoulder 55 give the lateral wall 5 of the base 2 a stepped profile.

In particular, as better illustrated in FIG. 4, the upper skirt 53 has a first portion, referred to as rear portion 531, of constant height. In addition, the upper skirt 53 has a second portion, referred to as front portion 532. The front portion 532 of the upper skirt 53 has a first region 532*a* of constant height, and two opposite regions located on either side of the first region 532*a*. Only a region of the front portion 532 is visible in FIG. 4. The regions each form a ramp, referred to as peripheral ramp 532*b*.

In addition, the annular lateral wall 5 has an undercut 56 carrying a pin 7. In addition, the annular lateral wall 5 has a flattened area 57 which is extended by a concave lower lip 58. The undercut 56 and the flattened area 57 are formed at the level of the upper skirt 53 of the annular lateral wall 5, and more precisely at the level of the front portion 532 of the upper skirt 53.

Figure 10:
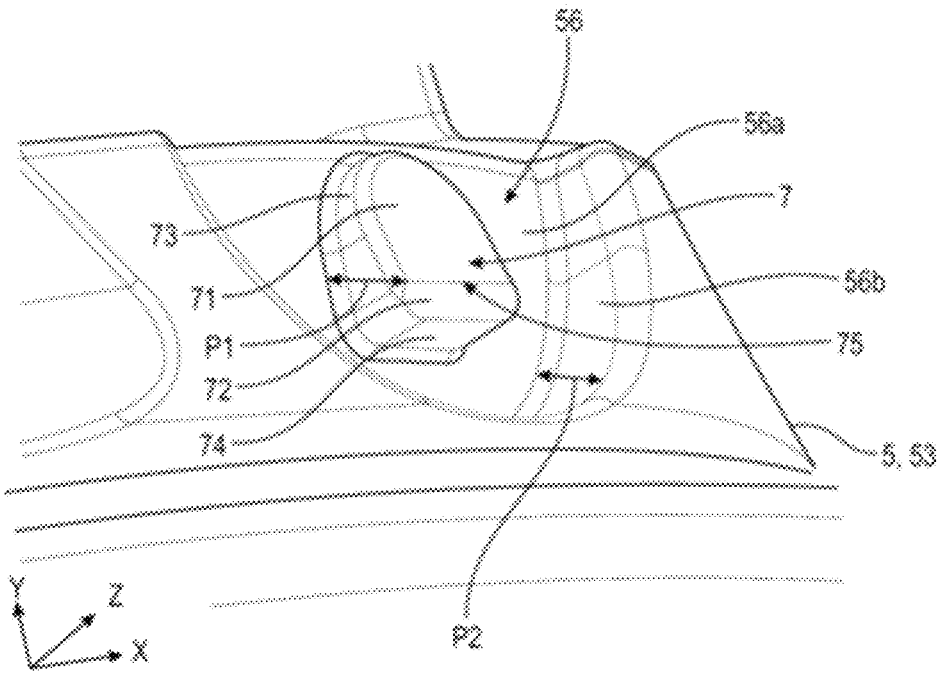
FIG. 10 is a left isometric view of a detail of FIG. 1.

With reference to FIG. 10, the undercut 56 has a first face 56*a* which carries the pin 7, and a second face 56*b* perpendicular to the first face 56*a*. In the illustrated example, the first face 56*a*, referred to as the vertical face, extends perpendicular to the upper wall 6 of the base 2. In addition, the first face 56*a* is convex and has a curvature similar to a curvature of the upper skirt 53. The second face 56*b* is concave and forms a U shape around the pin 7. The second face 56*b* is referred to as concave face.

Still referring to FIG. 10, the pin 7 extends perpendicular to the vertical face 56*a* of the undercut 56. Alternatively not shown, the pin 7 may be arranged at an angle to the vertical face 56*a* of the undercut 56. Whatever its orientation with respect to the vertical face 56*a* of the undercut 56, the pin 7 advantageously has a bevelled shape. In the illustrated example, the pin 7 comprises two planar front faces which extend at an angle to the vertical face 56*a* of the undercut 56. The planar front faces confer to the pin 7 its bevelled shape. The planar front face, referred to as upper front face 71, is connected to the vertical face 56*a* of the undercut 56 by a convex upper face 73 of the pin 7. The planar front face, referred to as lower front face 72, is connected to the vertical face 56*a* of the undercut 56 by a lower planar face 74 of the pin 7. The upper front face 71 and the lower front face 72 form an obtuse angle between them. Furthermore, the upper front face 71 and the lower front face 72 form an intersection line 75 between them corresponding to a distal edge of the pin 7. The lower front face 72 forms a chamfer between the upper front face 71 and the lower planar face 74.

It should be noted that the pin 7 has a maximum depth P1 which is defined between the vertical face 56*a* of the undercut 56 and the intersection line 75 along a line perpendicular to the vertical face 56*a* of the undercut 56. The maximum depth P1 of the pin 7 is less than or equal to a depth P2 of the undercut 56. The depths P1 and P2 are shown in FIG. 10.

Figure 11:
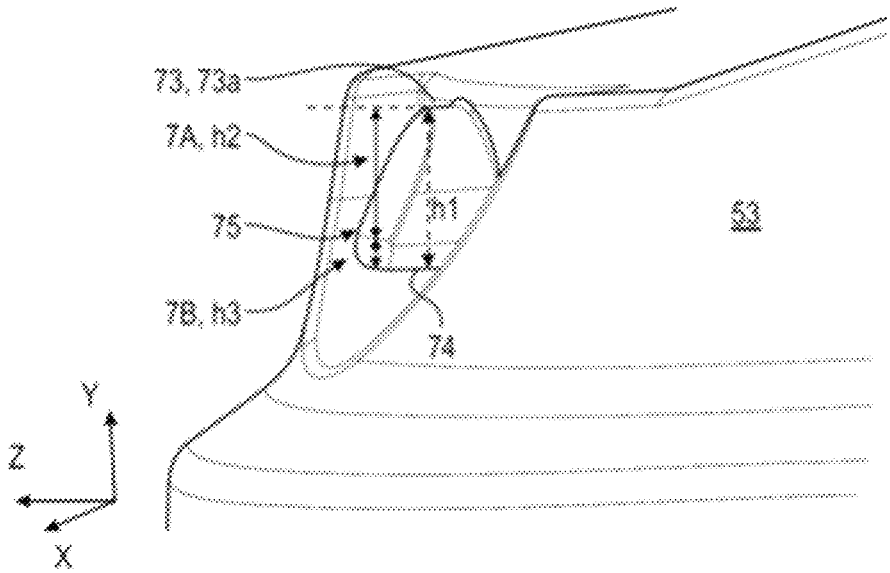
FIG. 11 is a right isometric view of FIG. 10.

With reference to FIG. 11, the pin 7 has a height h1 which is defined between a summit 73*a* of the convex upper face 73 and the lower planar face 74 of the pin 7 along a line perpendicular to the convex upper face 73 and/or the lower planar face 74. Summit means the highest point of the convex upper face 73. In addition, the pin 7 has an upper portion 7A and a lower portion 7B defined on either side of the intersection line 75. The upper portion 7A of the pin 7 has a height h2 which is defined between the summit 73*a* of the convex upper face 73 and the intersection line 75 of the pin 7 along a line perpendicular to the intersection line 75 and/or the convex upper face 73. The lower portion 7B of the pin 7 has a height h3 defined between the intersection line 75 and the lower planar face 74 of the pin 7, along a line perpendicular to the lower planar face 74 and/or the intersection line 75.

Referring again to FIGS. 1 to 4, the upper wall 6 of the base 2 comprises a first plate, referred to as top plate 61, and a second plate, referred to as bottom plate 62. The top plate 61 and the bottom plate 62 are connected by a vertical transverse wall 63 (visible in FIGS. 1 and 2). In the illustrated example, the vertical transverse wall 63 extends along a diameter of the upper wall 6. The vertical transverse wall 63 thus divides the upper wall 6 into two half-discs corresponding respectively to the top plate 61 and the bottom plate 62. Alternatively, the vertical wall 63 is eccentric with respect to the central axis Y of the tube head 1. This results in an uneven distribution between the top plate 61 and the bottom plate 62.

Figure 1:
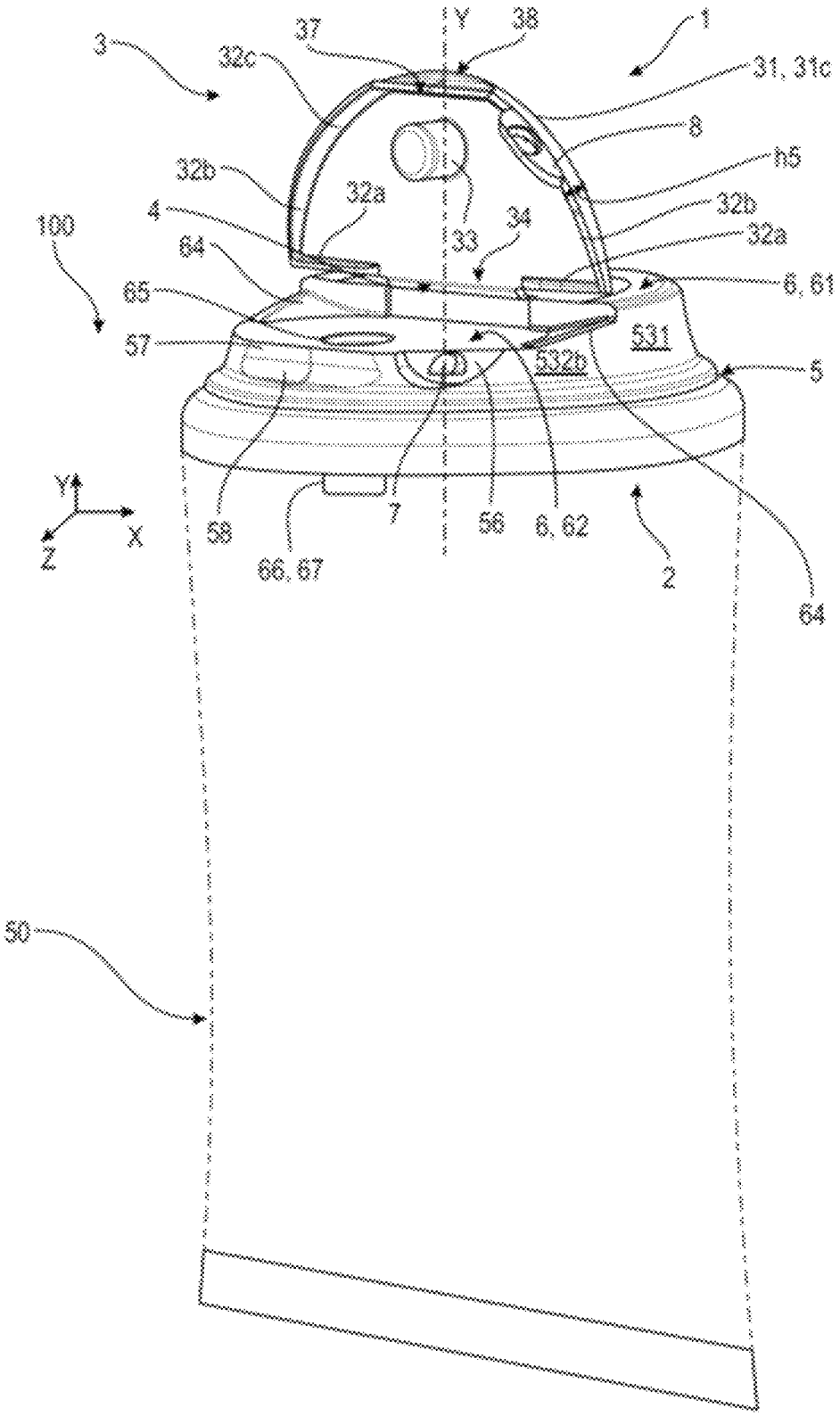
FIG. 1 is a right isometric view of a tube comprising a head according to the invention in an open configuration.
Figure 2:
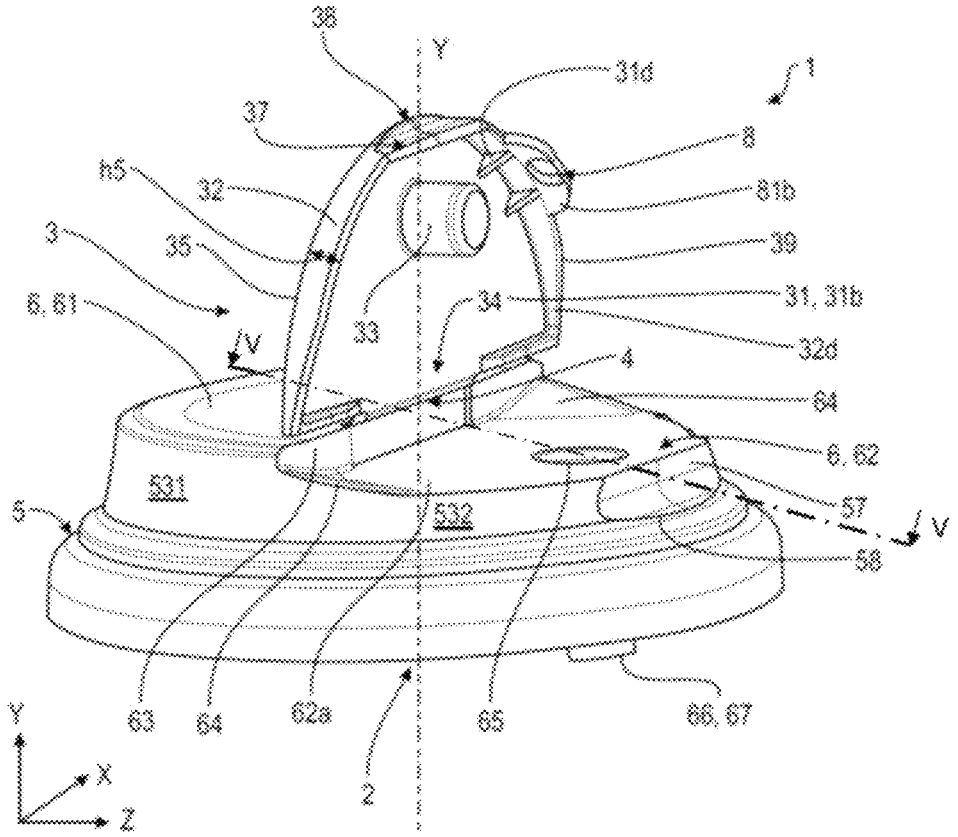
FIG. 2 is a left isometric view of the head according to the invention.
Figure 3:
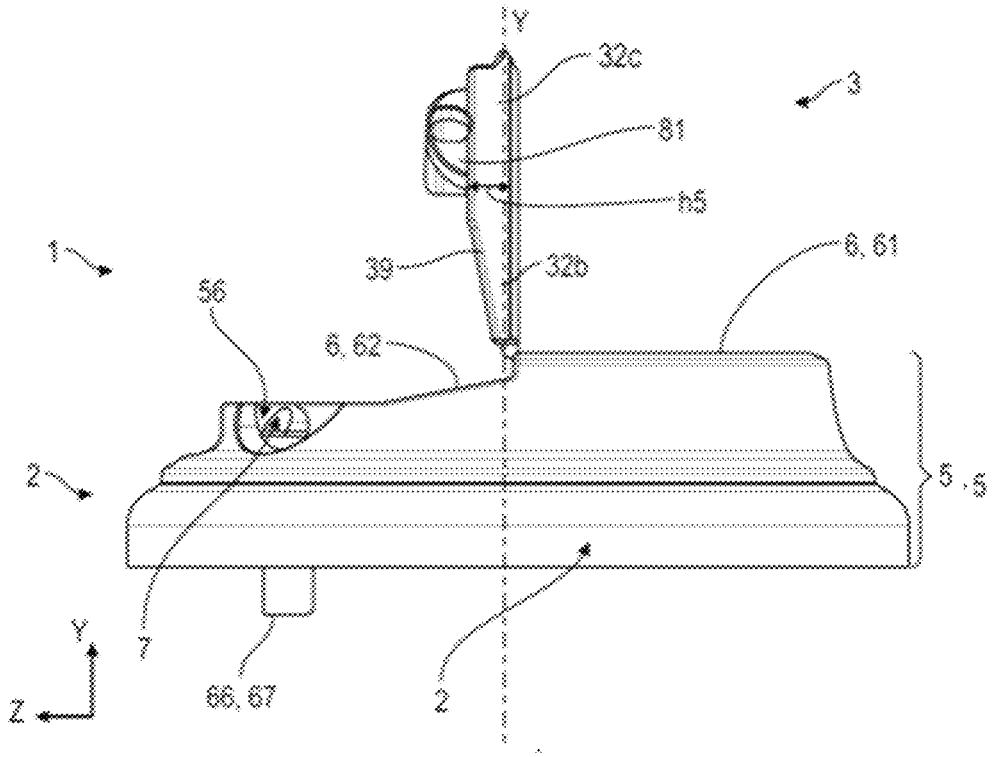
FIG. 3 is a right side view of the head according to the invention.

As best illustrated in FIGS. 1 and 2, the top plate 61 is adjacent to the rear portion 531 of the upper skirt 53. The bottom plate 62 is adjacent to the front portion 532 of the upper skirt 53. Furthermore, as best illustrated in FIG. 9, the top plate 61 has an external face 61*a*. The external face 61*a* is opposite an internal face 61*b* shown in FIG. 7. Finally, the top plate 61 has an edge which comprises a curvilinear portion 61*c* and a rectilinear portion 61*d*.

Referring again to FIGS. 1, 2, the bottom plate 62 has an external face 62*a* which is provided with two ramps 64 each formed at an angle between the bottom plate 62 and the vertical transverse wall 63. The ramps 64 of the bottom plate 62 are adjacent to the peripheral ramps 532*b* of the upper skirt 53. In addition, the bottom plate 62 has a dispensing orifice 65 which is extended by a protuberance 66.

As best illustrated in FIG. 7, the protuberance 66 extends into the volume V of the tube head 1. In addition, the protuberance 66 is formed on an internal face 62*b* of the bottom plate 62. The internal face (respectively externa face) is the face facing the internal volume V (respectively the face opposite the volume V).

The protuberance 66 allows the tube head 1 to be oriented, in particular with respect to a decoration and/or a longitudinal weld of a tube skirt during the manufacture of the tube. Thus, thanks to the protuberance 66, the skirt 50 can be attached in a suitable position. The protuberance 66 thus forms a means for positioning the tube head 1.

In order to ensure its function, the protuberance 66 has a portion 67, referred to as projecting portion, which projects from the volume V. The projecting portion 67 cooperates directly with the tooling of the production line of the tube and not with a component of the tube as is the case in the prior art. The projecting portion 67 is visible in particular in FIG. 5.

In the configuration shown in FIG. 5, the protuberance 66 has an upper proximal end 66*a* formed by the dispensing orifice 65 and a lower distal end 66*b* located at the level of the projecting portion 67. The proximal end 66*a* of the protuberance 66 is cylindrical in shape. Such a shape has the advantage of being particularly resistant. However, this shape limits access to the dispensing orifice 65 for the product contained in the tube equipped with the head 1. Advantageously, at least one part of the protuberance 66 has the shape of a half-cylinder. This half-cylinder shape allows both a sufficiently strong structure and easy access to the orifice 65 for the product contained in the tube equipped with the head 1. The proportion of the protuberance 66 in the shape of a cylinder may vary according to the dimensions of the head. In the illustrated configuration, a large proportion of the protuberance 66 is in the form of a half-cylinder, not just the projecting portion 67. In a configuration not shown, the entire protuberance 66 has the shape of a half cylinder.

The projecting portion 67 has a height h4 defined between a horizontal plane containing the lower edge 52 of the base 2 and the lower end 66*b* of the protuberance 66 along a line perpendicular to said plane. Advantageously, the height h4 of the projecting portion 67 is between 1.5 and 6 mm. Advantageously, the height h4 of the projecting portion 67 is between 2 and 4 mm. Advantageously, the height h4 of the projecting portion 67 is between 2.5 and 3.5 mm. Such a height h4 allows a reliable positioning of the head 1 according to the invention.

In the example shown, the dispensing orifice 65, as well as the protuberance 66, is eccentric, i.e. radially offset from the central axis Y of the tube head 1.

To reinforce its structure, and as illustrated in FIG. 7, the base 2 has at least one internal rib 9 in the volume V. In the illustrated embodiment, the base 2 comprises two ribs 9*a*, 9*b* which extend radially with respect to the central axis Y. The ribs 9*a*, 9*b* are formed diametrically opposite each other substantially adjacent to the vertical transverse wall 63.

With further reference to FIGS. 1 and 2, the cover 3 comprises a bottom 31 and a peripheral wall 32 which extends perpendicularly to the bottom 31. The bottom 31 of the cover 3 has an external face 31*a* (visible in FIG. 6) and an internal face 31*b* which is provided with a lug 33. The lug 33 allows the dispensing orifice 65 to be sealed when the cover 3 is in the closed position. In the illustrated example, the lug 33 has a tubular shape with an external diameter substantially equal to an internal diameter of the dispensing orifice 65. The peripheral wall 32 forms an opening 34 located at the level of the hinge 4.

As shown in FIG. 6, the bottom 31 of the cover 3 is in the form of a half-disc. Thus, the bottom 31 of the cover 3 has an edge 31*c* comprising a curvilinear portion 35 and a rectilinear portion 36. The curvilinear portion 35 has a rounded summit 35*a* located opposite the hinge 4. The rectilinear portion 36 is connected to the hinge 4. Furthermore, the peripheral wall 32 of the cover 3 extends along the entire curvilinear portion 35 of the edge 31*c* and over at least a fraction of the rectilinear portion 36 of the edge 31*c*. More specifically, the peripheral wall 32 of the cover 3 extends over two fractions 36*a*, 36*b* of the rectilinear portion 36 of the edge 31*b*. A remaining fraction 36*c* of the rectilinear portion 36 of the edge 31*c* is connected to the hinge 4.

While in the illustrated embodiment, the cover 3 occupies substantially a half of the surface area of the upper wall 6, in an alternative embodiment not shown, the cover 3 is eccentric with respect to the central axis Y of the head 1 and occupies less than the half of the surface area of the upper wall 6. In particular, this allows the size of the cover 3 to be reduced, thus limiting the amount of material required to manufacture the head 1.

Again with reference to FIG. 1, the peripheral wall 32 of the cover 3 has a height h5 which has different profiles along the edge 31*c* of the bottom 31 of the cover 3. Thus, the peripheral wall 32 of the cover 3 has two opposite regions 32*a* located on either side of the hinge 4, in which the height h5 increases before becoming constant. The peripheral wall 32 of the cover 3 has two further regions 32*b* each extending from an adjacent region 32*a*. In each of the regions 32*b*, the height h5 increases from the adjacent region 32*a*. Between the regions 32*b* of the peripheral wall 32 there extends a central front region 32*c* in which the height h5 is constant.

The regions 32*a* extend respectively along the fraction 36*a* and the fraction 36*b* of the rectilinear portion 36 of the edge 31*c*. The fractions 36*a*, 36*b* are visible in FIG. 6. The regions 32*b* of the peripheral wall 32 extend along the ends of the curvilinear portion 35 of the edge 31*c* of the bottom 31 (visible in FIG. 6). The regions 32*b* of the peripheral wall 32 of the cover 3 are intended to rest on the peripheral ramps 532*b* formed at the level of the upper skirt 53 of the base 2 when the cover 3 is in the closed position.

With further reference to FIG. 2, the peripheral wall 32 of the cover 3 has a flattened area 37 extending perpendicular to the bottom 31 of said cover 3. The flattened area 37 is located opposite the opening 34 formed by the peripheral wall 32 of the cover 3. More specifically, the flattened area 37 is located at the level of the central front region 32*c* of the peripheral wall 32 of the cover 3. In addition, the flattened area 37 forms a tab 38 with the bottom 31 of the cover 3 to facilitate the gripping of the cover 3 by a finger of a user. The tab 38 corresponds to the rounded summit 35*a* of the curvilinear portion 35 of the bottom 31 of the cover 3.

With reference to FIG. 2, the peripheral wall 32 of the cover 3 has a lower edge 39 which is provided with an annulus 8. More specifically, the annulus 8 is formed at the level of the central front region 32*c* of the peripheral wall 32. The annulus 8 is intended to cooperate with the pin 7 when the cover 3 is in the closed position, in particular before the tube is used for the first time. In addition, the annulus 8 is configured to be housed in the undercut 56 formed on the upper skirt 53 of the base 2.

As best illustrated in FIG. 12, the annulus 8 comprises two legs 81 which are formed opposite each other and at least one breakable bridge 82 which connects the legs 81. The legs 81 and the breakable bridge 82 thus define an opening 83 intended to be positioned around the pin 7.

In the following description in relation to the annulus 8, "internal" (respectively "external") is understood to mean a position close to (respectively distant from) the opening 83 of the annulus 8. "Front" (respectively "rear") means a position facing the outside of the cover 3 (respectively the inside of the cover 3).

The legs 81 extend from the lower edge 39 of the peripheral wall 32 perpendicular to the bottom 31. Thus the annulus 8 is perpendicular to the bottom 31 of the cover 3. In other words, the annulus 8 extends as an extension of the peripheral wall 32 of the cover 3.

Each leg 81 of the annulus 8 has a proximal edge 84*a* which is connected to the peripheral wall 32 of the cover 3, and more precisely to the lower edge 39 of said peripheral wall 32 of the cover 3. In addition, each leg 81 has a distal edge 84*b* which is connected to the breakable bridge 82. More specifically, the distal edge 84*b* of each leg 81 is connected to one end of the breakable bridge 82.

In the example shown, each leg 81 of the annulus 8 comprises a front face 81*a* and a rear face 81*b*. The rear face 81*b* is visible in FIG. 2. The front face 81*a* and the rear face 81*b* of each leg 81 are substantially curved and define a thickness e1 of said leg 81. The thickness e1 is substantially equal to a thickness of the peripheral wall 32 of the cover 3. In addition, each leg 81 of the annulus 8 comprises a concave internal face 81*c* and a convex external face 81*d*. The front face 81*a* and the rear face 81*b* of each leg 81 extend between the concave internal face 81*c* and the convex external face 81*d* of said leg 81.

The convex external face 81*d* and the concave internal face 81*c* of each leg 81 of the annulus 8 define a width 11 which is variable between the proximal edge 84*a* and the distal edge 84*b* of said leg 81. More specifically, the width 11 of each leg 81 decreases from the proximal edge 84*a* to the distal edge 84*b*. In other words, the width 11 of each leg 81 has a maximum value at the level of the proximal edge 84*a* of said leg 81 and a minimum value at the level of the distal edge 84*b* of said leg 81. Indeed, at the level of the proximal edge 84*a* of each leg 81, the concave internal face 81*c* and the convex external face 81*d* of said leg 81 diverge. At the level of the distal edge 84*b* of each leg 81, the concave internal face 81*c* and the convex external face 81*d* of said leg 81 converge. Thus, each leg 81 has a crescent shape. "Width" means a measurement taken in a direction parallel to the lower edge 39 of the peripheral wall 32 of the cover 3.

In the example shown, the breakable bridge 82 is in the form of a thin strip of material. "Thin" means that the material strip has a thickness e2 which is small in relation to a width 13 and a depth P3 of said material strip. The thickness e2 is defined between an internal face and an external face of the thin strip of the breakable bridge 82. The width 13 of the thin strip corresponds to a measurement taken between the distal portions 84*b* of the legs 81 in a direction parallel to the lower edge 39 of the peripheral wall 32 of the cover 3. The depth P3 is defined between a front face and a rear face of the thin strip of the breakable bridge 82.

It should be noted that the thickness e2 of the thin strip of the breakable bridge 82 is also small compared to the rest of the annulus 8 and in particular compared to the legs 81 so that the breaking of said thin strip of the breakable bridge 82 is facilitated when the cover 3 is first opened. Furthermore, the depth P3 of the thin strip of the breakable bridge 82 is variable. In particular, the depth P3 of the thin strip of the breakable bridge82 has a maximum value at the level of the ends of said thin strip of the breakable bridge 82, i.e. at the level of the junctions between the thin strip of the breakable bridge 82 and the legs 81. On the other hand, the depth P3 of the thin strip of the breakable bridge 82 has a minimum value towards a middle 82*a* of said thin strip of the breakable bridge 82. In other words, the thin strip of the breakable bridge 82 forms a constriction in its middle 82*a* corresponding to a minimum value of the depth P3. When the cover 3 is opened for the first time, this constriction constitutes a stress concentration area allowing the thin strip of the breakable bridge 82 to break in a localised manner.

It should be noted that the legs 81 and the breakable bridge 82 together form a U-shaped external surface. More specifically, this U-shaped external surface is formed by the respective convex external faces 81*d* of the legs 81 and the external face of the breakable bridge 82. Furthermore, the respective concave internal faces 81*c* of the legs 81 and the internal face of the breakable bridge 82 give the opening 83 of the annulus 8 a concave profile at the level of an upper portion of said opening and a substantially rectilinear profile at the level of a lower portion of said opening 83. The opening 83 thus defined has a width 12 which extends between the respective concave internal faces 81*c* of the legs 81, and in particular between two planes tangent to said faces 81*c* respectively. The opening 83 also has a height h6 which is defined between the breakable bridge 82 and a line 85 joining the legs 81. It should be noted that the line 85 joining the legs 81 extends perpendicular to the respective front faces 81*a* of the legs 81. In the example shown in FIG. 12, the connecting line 85 is represented by a simple arrow pointing to its position.

The height h6 defined by the opening 83 of the annulus 8 is greater than the depth P1 and the height h1 of the pin 7. Similarly, the width 12 of the opening 83 is slightly larger than a width of the pin 7. This makes it easier to place the annulus 8 around the pin 7, in particular when the cover 3 is first closed on the base 2.

To reinforce the structure of the annulus 8, and as illustrated in FIG. 2, the cover 3 comprises at least one rib 31*d* formed in the vicinity of said annulus 8. In particular, the rib or the ribs 31*d* are formed at an angle between the bottom 31 and the peripheral wall 32 of the cover 3. More specifically, the rib or the ribs 31*d* are formed between an internal face 31*b* of the bottom 31 and an internal face 32*d* of the peripheral wall 32. In the illustrated embodiment, the cover 3 comprises two ribs 31*d* which are formed at the level of the central front region 32*c* of the peripheral wall 32 of the cover 3. Such an arrangement of the ribs 31*d* allows to preserve the shape memory of the annulus 8 against the mechanical stresses induced by the action of the pin 7 on said annulus 8. The action of the pin 7 on the annulus 8 is the resistance opposing the pin 7 to the annulus 8 when the annulus 8 is placed around the pin 7 or removed.

In the closed position of the cover 3, the peripheral wall 32 co-operates with the upper skirt 53 of the base 2 to confers the head 1 a generally cylindrical shape and some continuity of design between the base 2 and the cover 3. Thus, the peripheral wall 32 of the cover 3 is supported on the front portion 532 of the upper skirt 53 of the base 2. In particular, the areas 32*b* of the peripheral wall 32 of the cover 3 are supported on the peripheral ramps 532*b* of the upper skirt 53 of the base 2. In addition, the flattened area 37 of the peripheral wall 32 of the cover 3 aligns with the flattened area 57 of the upper skirt 53 of the base 2. The flattened area 57 on the upper skirt 53 of the base 2 and the flattened area 37 on the peripheral wall 32 of the cover 3 form a housing with higher height for easy access and manipulation of the tab 38. Finally, the tab 38 formed at the level of the cover 3 is positioned opposite the lower lip 58 formed at the level of the base 2.

Furthermore, the bottom 31 of the cover 3 extends in a plane of the top plate 61 of the base 2. In other words, the external face 31*a* of the bottom 31 of the cover 3 aligns with the external face 61*a* of the top plate 61 of the base 2. In addition, the bottom 31 of the cover forms a housing 69 with the bottom plate 62, as shown in FIG. 9. On either side of the hinge 4, the rectilinear portion 36 of the bottom 31 forms a clearance with the rectilinear edge 61*d* of the top plate 61 to facilitate the pivoting of the cover 3 with respect to the base 2.

Finally, still in the closed position of the cover 3, the pin 7 opens out from the opening 83 of the annulus 8. Indeed, the depth P1 of the pin 7 is greater than the thickness e1 of the annulus 8. The U-shaped external face of the annulus 8 is positioned opposite the concave bottom 56*b* of the undercut 56. This external face is at a distance from the concave bottom 56*b*. The concave internal face of the annulus 8 is positioned opposite the convex upper face 73 of the pin 7. The lower planar internal face of the annulus 8 is positioned opposite the lower planar face 74 of the pin 7. The rear face of the annulus 8 is positioned opposite the vertical face 56*a* of the undercut 56.

It should be noted that in the closed position of the cover 3, the head 1 has a height h7 which is between 5 and 20 mm. Advantageously, the height h7 of the tube head 1 is between 8 and 12 mm. Advantageously, the height h7 of the tube head 1 is between 9.3 and 10.3 mm. The height h7 of the head 1 is defined between the external face 61*a* of the top plate 61 and the lower edge 52 of the annular lateral wall 5.

The height h7 of the head is relatively small, especially in relation to a diameter d of the head 1, which is between 30 and 50 mm, and advantageously still between 35 and 45 mm. Such a height h7 confers the head 1 a substantially flat design allowing to limit the amount of material. Advantageously, the ratio d/h7 is between 2 and 6. Advantageously, the ratio d/h7 is between 3 and 5. A ratio d/h7 as described above characterises the substantially flat design of the head 1.

Preferably, the ratio h7/h4 is between 1.5 and 5.5. Even more preferably, the ratio h7/h4 is between 2.5 and 4.5, in particular between 3 and 4.

Advantageously, the tube head 1 is made of a plastic material. The head 1 is produced in one part, for example by an injection moulding method. The manufacture of the tube head is designed so that at the end of this operation, the cover 3 is in an open position with respect to the base 2 as illustrated in particular in FIGS. 1 to 7. The principle of a cover 3 formed in an open position with respect to the base 2 allows in particular the realisation of the pin 7 on the base 2 and the realisation of the annulus 8 on the cover 3.

After manufacturing the head 1, it is necessary to fold the cover 3 onto the base 2 and maintain the two elements in position in order to allow the skirt 50 to be attached onto the head 1, and then to fill the tube 100 thus formed with a fluid or pasty product. The cover 3 must be maintained in position on the base 2 until the tube 100 is first opened by a user. This closed position is illustrated in FIGS. 8 and 9.

To maintain the cover 3 closed on the base 2 until the first use, the annulus 8 cooperates with the pin 7. Thus, the legs 81 and the breakable bridge 82 of the annulus 8 form first means of the anti-tamper system. The pin 7 forms a second means of the anti-tamper system. The breakable bridge 82 also serves as a witness to know whether the tube 100 has already been opened or not. Its connection to the legs 81 certifies that the cover 3 has not yet been opened.

When the cover 3 is first closed on the base 2 for the purposes mentioned above, the annulus 8 of the cover 3 is threaded around the pin 7 of the base 2 (see FIG.—13A). The bevelled upper and lower front faces 71, 72 of the pin 7 facilitate this manoeuvre during which only the upper concave portion of the opening 83 of the annulus 8 is in contact with the pin 7. This allows to preserve the integrity of the breakable bridge 82 and prevents it from breaking. Indeed, the concave upper portion of the opening 83 of the annulus 8 delimits an area of said annulus 8 which is stronger in comparison with an area of said annulus 8 which is less strong and which comprises the breakable bridge 82.

Figure 14:
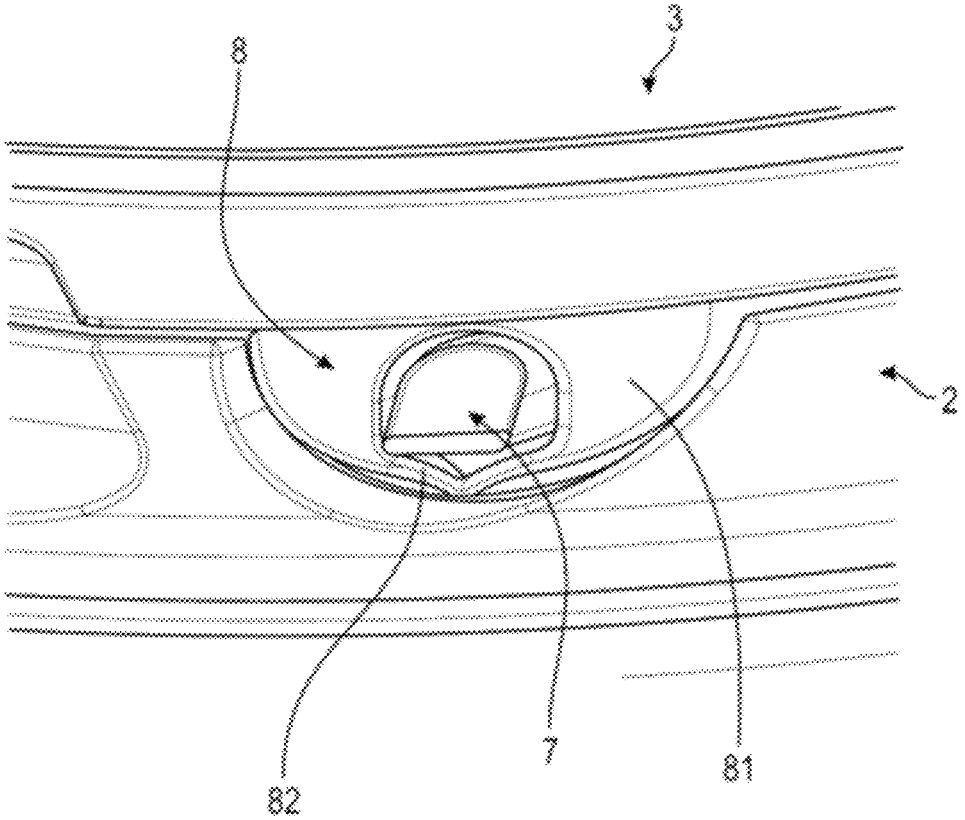
FIG. 14 illustrates a further state of the anti-tamper system in FIG. 13.

On the other hand, when the cover 3 is opened for the first time with respect to the base 2, the breakable bridge 82 comes into contact with the pin 7. More specifically, the internal face of the breakable bridge 82 abuts the lower planar face 74 of the pin 7. Thus, as shown in FIG. 14, when the impetus for the cover 3 to open is sufficient, the breakable bridge 82 of the annulus 8 deforms before breaking. The deformation of the breakable bridge 82 is made possible by the clearance formed between the external face of the annulus 8 and the concave bottom 56*b* of the undercut 56. The breaking of the breakable bridge 82 following the first opening of the cover 3 is illustrated in FIG.—13B.

Since the breakable bridge 82 is less strong than the pin 7, the latter cannot be deformed by the former. Furthermore, due to the planar horizontal configuration of the lower planar face 74 of the pin 7, and due to a judiciously chosen ratio P1/P3 between the depth P1 of the pin 7 and the depth P3 of the breakable bridge 82, the annulus 8 cannot be unthreaded entirely from the pin 7. Advantageously, the depth P1 of the pin 7 is at least twice the depth P3 of the breakable bridge 82. Thus, breaking the breakable bridge 82 is the only possible option for releasing the annulus 8 from the pin 7 and thus proceeding with a first opening of the cover 3 with respect to the base 2.

In order to achieve this break in the breakable bridge 82, the user does not have to carry out an additional action. The breakable bridge 82 is broken with a conventional gesture of opening the cover 3. In the illustrated embodiment, the gesture of opening the cover 3 is an upward push applied to the tab 38.

Advantageously, the breakable bridge 82 is broken without loss of material. In addition, the breakable bridge 82 is broken in such a way that the structure and the shape of the legs 81 forming the annulus 8 are preserved overall. In particular, the respective distal portions of the legs 81 retain an arched profile. This advantage is achieved in particular by choosing a leg width that decreases from the proximal edge towards the distal edge of said leg. This advantage is also achieved by the reduced thickness e2 of the breakable bridge 82 and by the constriction provided along the depth P3 of the breakable bridge 82, i.e. along a direction perpendicular to the thickness e2 of the breakable bridge 82.

Figure 15:
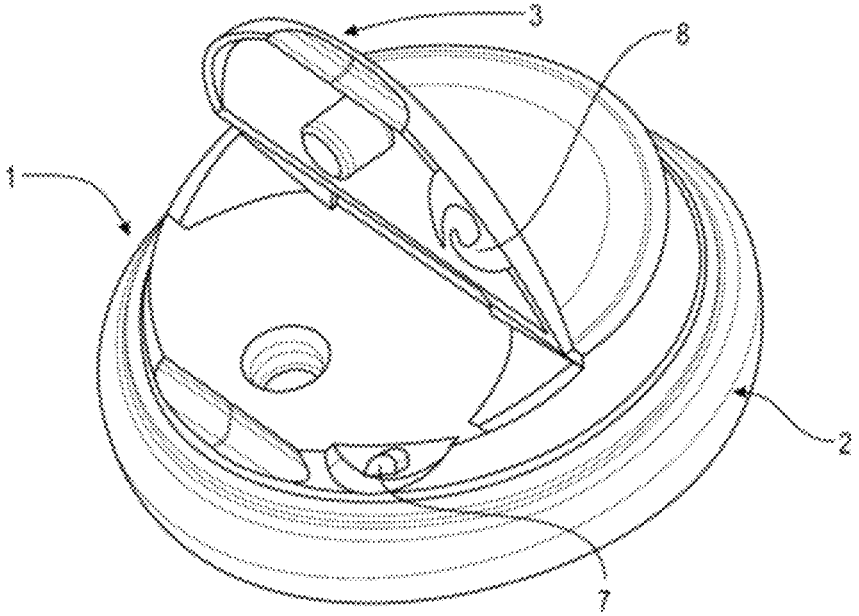
FIG. 15 is an isometric view of a tube head according to the invention after a first opening.

After the breakable bridge 82 has been broken, the respective concave faces 81*c* of the legs 81 and the branches of the broken breakable bridge 82 form an open loop (see FIG. 15). Thus, one element of the anti-tamper system, in this case the annulus 8, provides an aesthetic function after the breakable bridge 82 has broken. In addition, the distal portions of the legs 81 form, by virtue of their arcuate profile, flexible hooks which can cooperate with the pin 7 to ensure that the cover 3 is held in a closed position on the base 2 when the cover 3 is subsequently closed (see FIG. 13C). In particular, the flexible hooks deform angularly on contact with the pin 7 and then return to their original shape when placed around the pin 7. Thus, thanks to the invention, the anti-tamper system retains a function of maintaining the cover in the closed position after the breakable bridge has been broken, whereas in the prior art the elements of the anti-tamper system are either intended to be discarded or rendered unusable after the breakable bridge has been broken. It should be noted that the solution for maintaining the cover 3 in relation to the base 2 as implemented by the flexible hooks and the pin 7 complements or replaces a maintaining solution implementing the lug 33 and the dispensing orifice 65.

In order to disengage the flexible hooks from the pin 7 when the cover 3 is subsequently opened, the user exerts less effort than that required to break the breakable bridge 82 when the cover 3 is first opened. Thus, the drop in the opening force of the cover 3 relative to the base 2 indicates to the user that a first opening of the cover 3 has already taken place.

The invention claimed is:

1. A head for manufacturing of a flexible tube for containing a liquid or pasty product, having a reduced height in relation to its diameter and comprising a base configured to be attached to a skirt of said tube and a cover pivotally mounted on the base between an open position and a closed position, the head comprising at least one anti-tamper system having at least two legs projecting from the cover and permanently in connection with the cover, the at least two legs being connected to each other by at least one continuous breakable bridge, wherein the at least two legs are opposite and each of the at least two legs has a distal portion positioned around a pin of the base in the closed position, the structure and the shape of the at least two legs being preserved after breaking the at least one breakable bridge in the closed position, each of the at least two legs having its distal-portion that forms a flexible hook that deforms angularly on contact with the pin when opening or closing the cover and return to their original shape around the pin in the closed position to ensure that the cover is held in the closed position on the base after breaking the at least one breakable bridge.

2. The head according to claim 1, wherein the at least one breakable bridge is designed in such a way that, when the cover is closed for a first time, the at least legs cooperate with the pin of the base without breaking the at least one breakable bridge and that, when the cover is opened for the first time, the at least one breakable bridge is broken.

3. The head according to claim 2, wherein the pin is bevelled so as to facilitate a placing and a maintain of the at least legs around the pin.

4. The head according to claim 2, wherein the pin extends in projection from a lateral wall of the base in an orthogonal direction or a direction inclined with respect to said lateral wall.

5. The head according to claim 4, wherein the pin is formed in an undercut embodied in the lateral wall of the base, the at least legs being intended to be housed in said undercut when the cover is in the closed position.

6. The head according to claim 4, wherein when the cover is in the closed position, the at least one breakable bridge is located at a distance from a concave bottom of an undercut embodied in the lateral wall of the base.

7. The head according to claim 2, wherein the at least legs extend from a lower edge of a lateral wall of the cover in a plane of said lateral wall, the legs and the at least one breakable bridge forming an opening intended to be positioned around the pin.

8. The head according to claim 7, wherein the at least two legs and the at least one breakable bridge form, around the opening, a concave internal face and a rectilinear internal face, the concave internal face being intended to be supported on an upper convex face of the pin, the rectilinear internal face being intended to be positioned opposite a horizontal lower planar face of the pin.

9. The head according to claim 7, wherein the opening formed by the at least two legs and the at least one breakable bridge has a height greater than a height and a depth of the pin so as to prevent, when the at least two legs are placed around the pin, any contact between the at least one breakable bridge and the pin.

10. The head according to claim 7, wherein the pin opens out of the opening formed by the at least two legs and the at least one breakable bridge when the cover is in the closed position.

11. The head according to claim 1, wherein the at least one breakable bridge is thinner than the at least two legs.

12. The head according to claim 1, wherein the at least one breakable bridge is configured to be broken without loss of material upon a first opening of the cover.

13. A tube comprising head according to claim 1 and a flexible skirt.

14. The tube according to claim 13, wherein the skirt is attached directly to the head.

* * * * *